US007572167B2

(12) United States Patent
Cheng

(10) Patent No.: US 7,572,167 B2
(45) Date of Patent: Aug. 11, 2009

(54) PANTRY CORSELET WITHOUT BUCKLE STRUCTURES

(75) Inventor: Liza Cheng, Shenzhen (CN)

(73) Assignee: Embry (China) Garments Ltd, Shenzhen (CN)

( * ) Notice: Subject to any disclaimer, the term of this patent is extended or adjusted under 35 U.S.C. 154(b) by 0 days.

(21) Appl. No.: 12/131,937

(22) Filed: Jun. 3, 2008

(65) Prior Publication Data

US 2009/0000014 A1 Jan. 1, 2009

(30) Foreign Application Priority Data

Jun. 29, 2007 (CN) ..... 2007 2 0121143 U

(51) Int. Cl.
*A41C 3/00* (2006.01)

(52) U.S. Cl. ..... 450/6; 450/7; 450/96

(58) Field of Classification Search ..... 450/6–11, 450/14–16, 19–23, 30, 33, 94–96, 113
See application file for complete search history.

(56) References Cited

U.S. PATENT DOCUMENTS 1,067,289 A * 7/1913 Volk ..... 450/61
1,792,180 A * 2/1931 Merckelbach ..... 450/6
2,918,920 A * 12/1959 Lutsky ..... 450/2
7,387,561 B2 * 6/2008 Zarabi ..... 450/22

* cited by examiner

*Primary Examiner*—Gloria Hale
(74) *Attorney, Agent, or Firm*—Jianq Chyun IP Office

(57) ABSTRACT

A panty corselet without buckle structures including a corset portion and a pants portion is disclosed. The pants portion includes a front rise and two connection belts connected to a lower edge of the corset portion and adjacent to the front rise. One end of each of the two connection belts is connected to a bottom edge of the corset portion on each hip side, and the other end to a bottom edge of the front rise at a crotch area, thereby forming two openings through which a wearer's thighs could pass. As the panty corselet of this present invention is not provided with buckles, it enables women to take off or put on the panty corselet conveniently. Moreover, the ends of the two connection belts are respectively stitched to the corset portion and the front rise, thus bring comfort to wearing and overcome the defects in current technology.

5 Claims, 3 Drawing Sheets

PANTRY CORSELET WITHOUT BUCKLE STRUCTURES

CROSS-REFERENCE TO RELATED APPLICATION

This application claims the priority benefit of China application serial no. 200720121143.3, filed on Jun. 29, 2007. All disclosure of the China application is incorporated herein by reference.

BACKGROUND OF THE INVENTION

1. Field of the Invention

The present invention generally relates to the field of clothing and underwear, in particular, to a panty corselet without buckle structures.

2. Description of Related Art

Currently popular panty underwear, such as panty corselet, is usually provided with two types of buckle structures to enable women to take off or put on the panty corselet conveniently. One type indicates arrangement of openable buckles disposed around the crotch. However, these buckles are rigid, and therefore result in discomfort of wearing the underwear with such buckles, especially the panty corselet. The other type indicates arrangement of a removable connection structure between the pants and the corset. However, to achieve such connection, many accessories related should be used and much area is required, especially when zippers are applied as connection members, thereby greatly deteriorating comfort of wearing the panty corselet with such a connection structure. Therefore, both the previous two buckle structures are not suitable and comfortable for women. There is a need for panty underwear which could enable women to take off or put on the panty corselet conveniently and comfortably.

SUMMARY OF THE INVENTION

The present invention aims to provide a panty corselet without buckle structures, which is suitable and comfortable for wearing.

The present invention provides a panty corselet without buckle structures, including a corset portion and a pants portion that are connected as a whole. The pants portion comprises a front rise and two connection belts, the front rise having a crotch area, and each of the two connection belts is connected to a lower edge of the corset portion and adjacent to the front rise and form two openings through which a wearer's thighs could pass.

In an embodiment according to the present invention, an upper edge of the front rise is connected to a bottom edge of the corset portion on a front side, one end of each of the two connection belts is connected to the bottom edge of the corset portion on each hip side, and the other end of each of the two connection belts is connected to a bottom edge of the front rise at the crotch area.

In an embodiment according to the present invention, the ends of two connection belts are respectively stitched to the corset portion and the front rise.

In an embodiment according to the present invention, the two connection belts circle the thighs and pull the front rise downwardly, when in wearing.

In an embodiment according to the present invention, the two connection belts are made of elastic fiber.

In an embodiment according to the present invention, the front rise is made of elastic fiber.

The panty corselet of the present invention brings amazing comfort to women in taking off the front rise of the panty corselet without difficulty. Due to such a design, the panty corselet of the present invention is arranged with no buckles for connection at the crotch, thereby overcoming the defects in the current technology. Besides, the corset and the pants of the panty corselet of the present invention are connected through stitching, thus enabling wearing of the panty corselet more comfortable for women.

DESCRIPTION OF THE EMBODIMENTS

The following embodiments and drawings are merely intended to further demonstrate and illustrate the present invention, but not to limit the scope of the present invention.

A panty corselet without buckle structures of this present invention includes a corset portion 1 and a pants portion. The corset portion 1 is designed in the same structure as existing panty underwear, and connected to the pants portion at one end as a whole. To make wearing of the panty corselet convenient, the pants portion of the panty corselet of the present invention includes a front rise 2 and two connection belts 3. The front rise 2 has a crotch area at a bottom edge thereof. The connection belts 3 extend from the crotch area and curve around the wearer's legs in use and connect to the bottom edge of the corset portion 1. Each of the two connection belts 3 is connected to a lower edge of the corset portion 1 and adjacent to the front rise 2, and form two openings together with the front rise 2 and the corset portion 1. A wearer's thighs could pass through the openings when in wearing.

Figure 1:
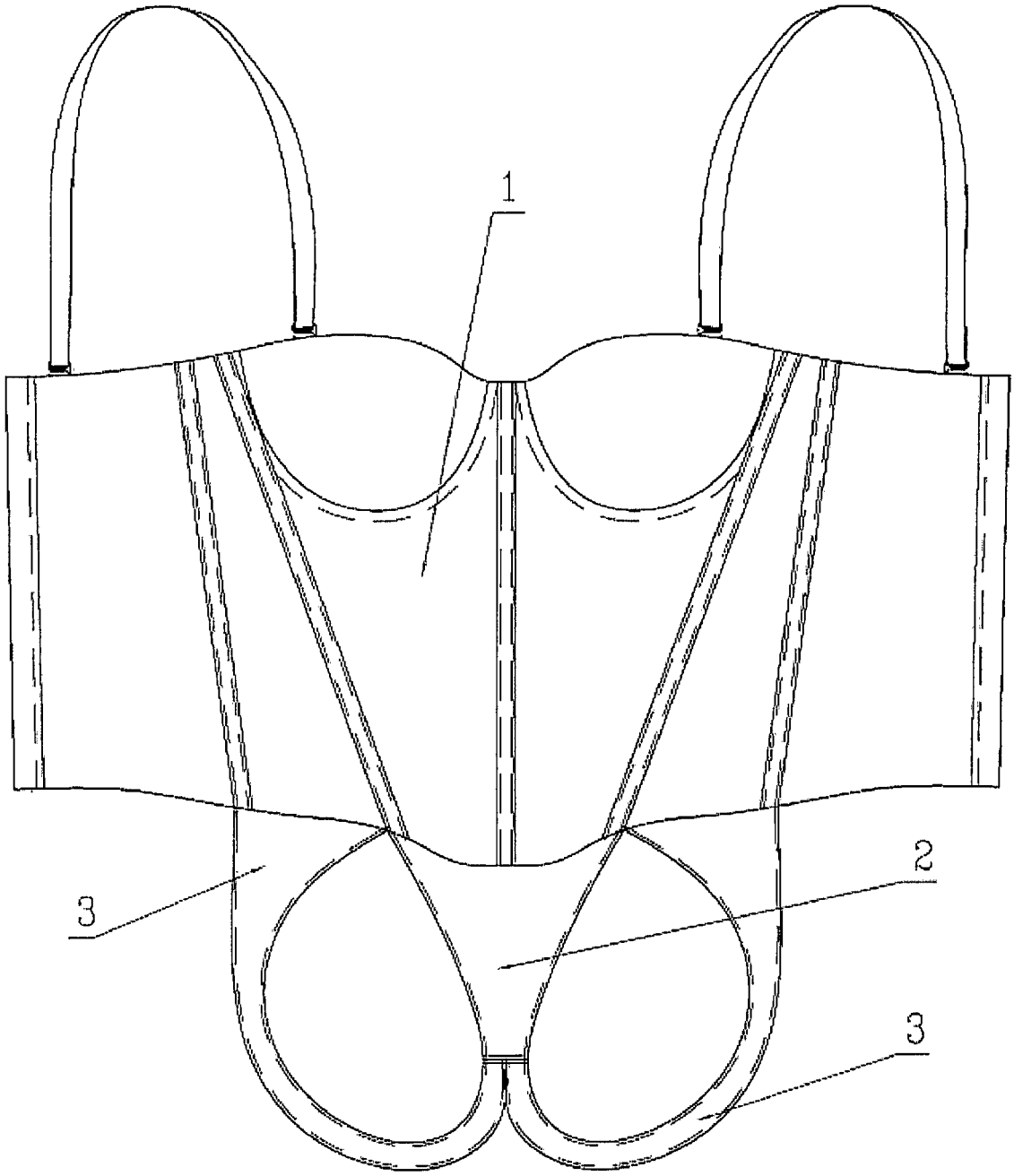
FIG. 1 is a perspective view of a panty corselet without buckle structures according to one embodiment of the present invention.
Figure 2:
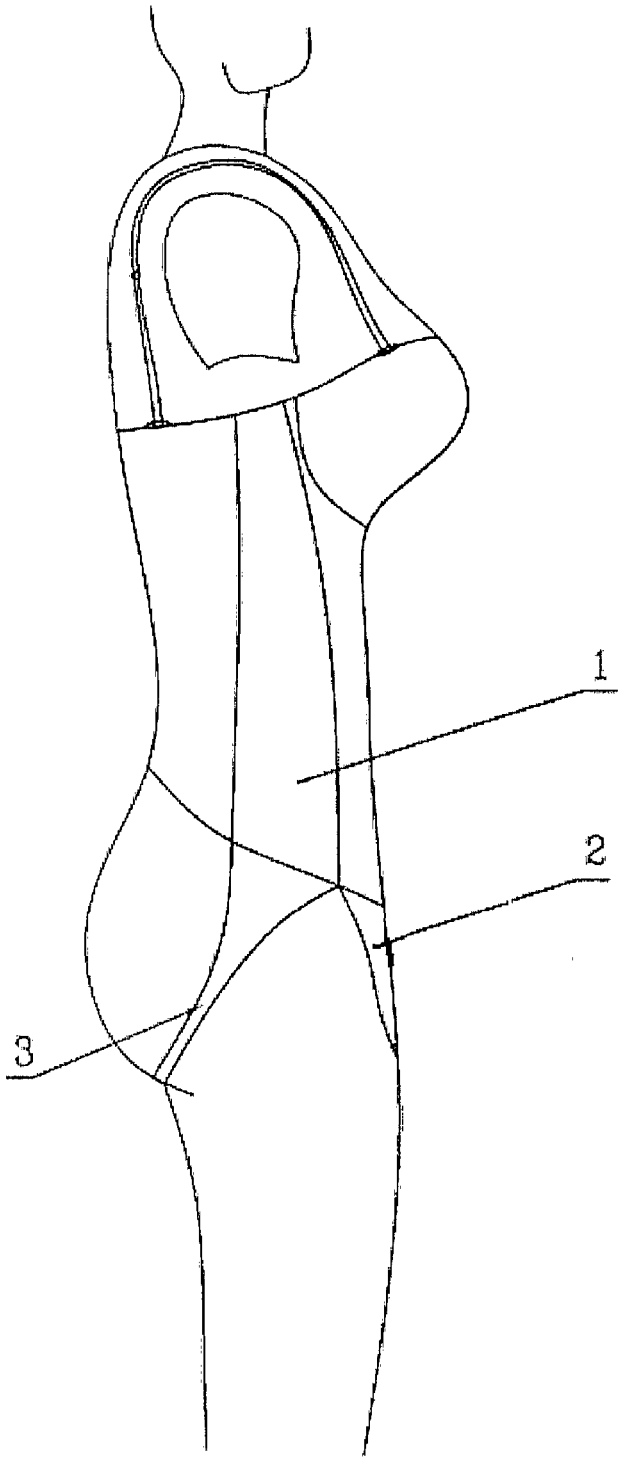
FIG. 2 is a schematic view of the panty corselet without buckle structures of FIG. 1 when in wearing.

As shown in the FIG. 1, an upper edge of the front rise 2 is connected to a bottom edge of the corset portion 1 on a front side, such as by stitch means. One end of each of the two connection belts 3 is connected to the bottom edge of the corset 1 on each hip side, and the other end is connected to a bottom edge of the front rise 2. Herein, the term "hip side" means an upper left or right portion around a person's hip. As shown in FIG. 2, when in wearing, the two connection belts 3 circle the thighs, and pull the front rise 2 downwardly. To ensure comfort of wearing, the ends of two connection belts 3 are respectively stitched to the corset portion 1 and the front rise 2. Thus the need for buckles and zippers (partially made of rigid materials) are avoided herein.

Figure 3:
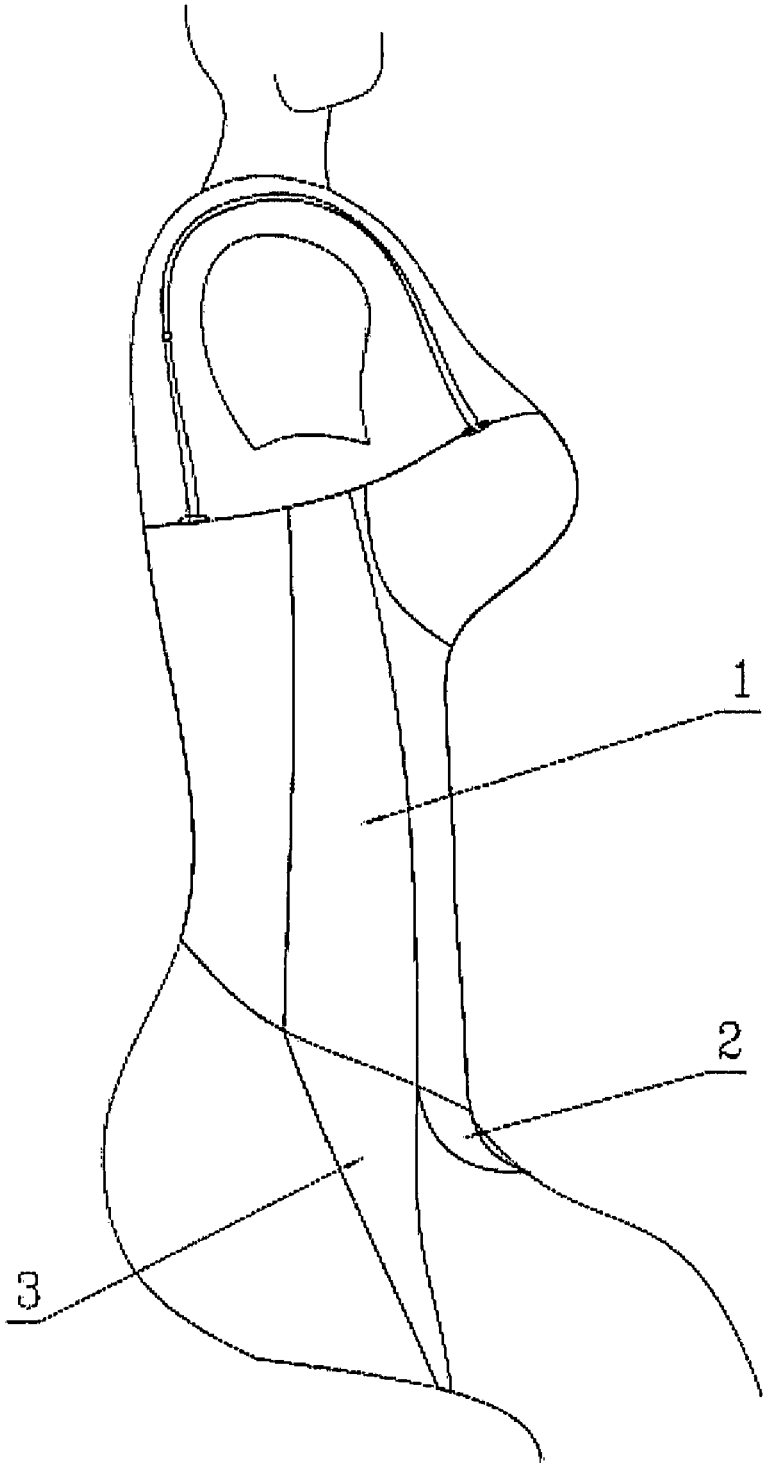
FIG. 3 is a schematic view of the panty corselet without buckle structures of FIG. 1 when the pants are taken off.

In the present invention, the two connection belts 3 and the front rise 2 can be made of fiber for the figure-clinging purpose. More particularly, the two connection belts 3 and the front rise 2 can be made of elastic fiber, thus bringing convenience to wearing of the panty corselet. Referring to FIG. 3, the panty corselet of this present invention enables women to take off the pants easily when in the women's room.

What is claimed is:

1. A panty corselet without buckle structures, comprising:

a corset portion; and a pants portion, connected with the corset portion as a whole, wherein the pants portion comprises a front rise and two connection belts, the front rise having a crotch area, and an upper edge of the front rise is connected to a bottom edge of the corset portion on a front side, one end of each of the two connection belts is connected to the bottom edge of the corset portion on each hip side, and the other end of each of the two connection belts is connected to a bottom edge of the front rise at the crotch area, and form two openings through which a wearer's thighs could pass.

2. The panty corselet without buckle structures of claim 1, wherein: the ends of the two connection belts are respectively stitched to the corset portion and the front rise.

3. The panty corselet without buckle structures of claim 2, wherein: when in wearing, the two connection belts circle the thighs, and pull the front rise downwardly.

4. The panty corselet without buckle structures of claim 1, wherein: the two connection belts are made of elastic fiber.

5. The panty corselet without buckle structures of claim 1, wherein: the front rise is made of elastic fiber.

* * * * *

UNITED STATES PATENT AND TRADEMARK OFFICE

CERTIFICATE OF CORRECTION

PATENT NO. : 7,572,167 B2
APPLICATION NO. : 12/131937
DATED : August 11, 2009
INVENTOR(S) : Liza Cheng It is certified that error appears in the above-identified patent and that said Letters Patent is hereby corrected as shown below:

On the Title Page, please replace item (54) with

-- PANTY CORSELET WITHOUT BUCKLE STRUCTURE --

Signed and Sealed this

Sixth Day of October, 2009

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,572,167 B2
APPLICATION NO. : 12/131937
DATED : August 11, 2009
INVENTOR(S) : Liza Cheng It is certified that error appears in the above-identified patent and that said Letters Patent is hereby corrected as shown below:

On the Title Page, please replace item (54) and at Column 1, lines 1 and 2, with

-- PANTY CORSELET WITHOUT BUCKLE STRUCTURE --

This certificate supersedes the Certificate of Correction issued October 6, 2009.

Signed and Sealed this

Twenty-seventh Day of October, 2009

David J. Kappos

David J. Kappos
*Director of the United States Patent and Trademark Office*